US007891584B2

(12) United States Patent
Ganser

(10) Patent No.: US 7,891,584 B2
(45) Date of Patent: Feb. 22, 2011

(54) FUEL INJECTION VALVE

(75) Inventor: Marco Ganser, Oberageri (CH)

(73) Assignee: Ganser-Hydromag AG (CH)

( * ) Notice: Subject to any disclaimer, the term of this patent is extended or adjusted under 35 U.S.C. 154(b) by 543 days.

(21) Appl. No.: 11/911,515

(22) PCT Filed: Apr. 4, 2006

(86) PCT No.: PCT/CH2006/000191

§ 371 (c)(1),
(2), (4) Date: Oct. 12, 2007

(87) PCT Pub. No.: WO2006/108309

PCT Pub. Date: Oct. 19, 2006

(65) Prior Publication Data

US 2008/0210784 A1 Sep. 4, 2008

(30) Foreign Application Priority Data

Apr. 14, 2005 (CH) ..... 0676/05
Jul. 1, 2005 (CH) ..... 1115/05

(51) Int. Cl.
*F02M 61/20* (2006.01)
*F02M 59/00* (2006.01)
*F02M 39/00* (2006.01)

(52) U.S. Cl. ..... 239/533.9; 239/88; 239/533.2; 239/533.3; 123/446

(58) Field of Classification Search ..... 239/88–92, 239/96, 533.11, 533.2, 533.3, 534.4, 533.9; 123/446
See application file for complete search history.

(56) References Cited

U.S. PATENT DOCUMENTS 1,762,550 A * 6/1930 French ..... 123/271
1,883,866 A 10/1932 Baur
2,985,378 A 5/1961 Falberg (Continued)

FOREIGN PATENT DOCUMENTS

DE 474578 4/1929

(Continued)

OTHER PUBLICATIONS

English Translation of the International Preliminary Report on Patentability (German Language Report mailed on Aug. 20, 2007).

(Continued)

*Primary Examiner*—Dinh Q Nguyen
*Assistant Examiner*—Justin Jonaitis
(74) *Attorney, Agent, or Firm*—Hershkovitz & Associates, LLC; Abraham Hershkovitz

(57) ABSTRACT

The housing body (14) of the fuel injection valve comprises a recess (108), the end region of said recess having a conical tapering (110) on the bottom side thereof. The supporting body (48) engages in said conical tapering (110) with a projection (116) also comprising a conical end region (118). The closing spring (40) is supported on the needle-shaped injection valve member (34) on one side, and on the guiding sleeve (38) on the other side. The guiding sleeve (38) is supported on the supporting body (48) with the front side (461) thereof, whereby the supporting body is held against the tapering (110) in a sealing manner, under the force exerted by the closing spring (40).

18 Claims, 7 Drawing Sheets

U.S. PATENT DOCUMENTS

| | | | | |
|---|---|---|---|---|
| 4,416,229 | A | 11/1983 | Wood | |
| 4,572,433 | A * | 2/1986 | Deckard | 239/88 |
| 4,709,679 | A * | 12/1987 | Djordjevic et al. | 123/447 |
| 4,856,713 | A * | 8/1989 | Burnett | 239/113 |
| 5,067,658 | A | 11/1991 | De Matthaeis et al. | |
| 5,357,933 | A * | 10/1994 | Kasahara et al. | 123/506 |
| 6,318,643 | B1 * | 11/2001 | Cooke | 239/71 |
| 2001/0013556 | A1 * | 8/2001 | Ganser | 239/88 |
| 2003/0141472 | A1 | 7/2003 | Mattes | |

FOREIGN PATENT DOCUMENTS

| | | |
|---|---|---|
| DE | 513710 | 12/1930 |
| DE | 765232 | 8/1954 |
| DE | 101 37 890 | 6/2002 |
| DE | 101 21 340 | 11/2002 |
| EP | 0 385 397 | 9/1990 |
| GB | 885627 | 12/1961 |
| WO | WO 2004/040119 | 5/2004 |
| WO | WO 2004/099603 | 11/2004 |

OTHER PUBLICATIONS

ISR mailed on Jul. 11, 2006 in PCT/CH2006/000191.
English abstract of German patent document DE 101 21 340 supplied from the esp@cenet database-Worldwide.

* cited by examiner

FUEL INJECTION VALVE

The present invention relates to a fuel injection valve for intermittent injection of fuel into the combustion space of an internal combustion engine.

A fuel injection valve is known, for example, from DE 10121340 A1. It has a housing body and a nozzle body pressed against said housing body at the end face in a sealing manner by means of cap nut. Said nozzle body defines a high-pressure space which is connected to a fuel high-pressure inlet arranged on the housing body and to an injection valve seat on the nozzle body. Located in the high-pressure space is a longitudinally adjustable injection valve member which interacts on the one side with the injection valve seat and defines on the other side, in the manner of a piston, a control space connected to the high-pressure space via a choke inlet. Furthermore, the control space is defined by a supporting body of groove-like design, in which the injection valve member engages and on which it is mounted in a sliding fit. A closing spring is supported on the one side on the valve member and on the other side on the supporting body, which is held in contact with the housing body by the force of the spring. Furthermore, a choke outlet runs through the supporting body from the control space, which choke outlet can be connected to and separated from a low-pressure outlet by means of an actuator-controlled pilot valve for the hydraulic control of the movement of the injection valve member. A pilot valve member controlled by means of an actuator interacts with a pilot valve seat formed on the supporting body. In order to achieve reliable sealing of the high-pressure space between the housing body and the supporting body at the very high operating pressures for the fuel, it is necessary to lap the relevant surfaces, which involves a considerable production outlay and expenditure.

An object of the present invention is to provide a fuel injection valve which permits a short axial design of the nozzle body.

This object is achieved with a fuel injection valve as claimed.

A fuel injection valve as claimed in claim 1 permits such a short axial design of the nozzle body by virtue of the fact that there is space for it together with a cap nut in a passage of a cylinder head of the internal combustion engine and yet it projects only slightly in a known manner beyond the cylinder head into the relevant combustion space.

Furthermore, an object of the present invention is to provide a fuel injection valve which can be produced in a simpler and more favorable manner.

The housing body has a recess open in the direction of the nozzle body and having a taper in the end region remote from the nozzle body. The supporting body engages in the recess, where it is held in sealing contact with the taper by means of the closing spring. This embodiment according to the invention permits reliable sealing of the high-pressure space between the housing body and the supporting body even when the taper and that part of the supporting body which interacts with the latter are ground. In addition, simpler assembly is ensured by the supporting body being automatically centered on the taper. In addition, the fuel injection valve according to the invention permits the arrangement of the taper deep in the housing body, since grinding in deep recesses is certainly possible, but lapping is no longer possible at acceptable cost. Such deep recesses in the housing body permit a space-saving, in particular short, construction of the fuel injection valve and of the nozzle body. This is very advantageous when using the fuel injection valve in large diesel engines, such as, for example, marine or generator engines.

An especially preferred embodiment of the fuel injection valve according to the invention is specified in the claims. Since the supporting body has a conical end region whose cone angle is designed to be larger, but preferably only slightly larger, than the cone angle of the taper of the recess in the housing body, a very narrow sealing surface in the shape of a lateral surface of a truncated cone is achieved, as a result of which an especially reliable sealing effect is ensured. Since the sealing surface in this case comes to lie on a large radius of the cones, hydraulic forces acting in the lifting direction are minimized.

The same correspondingly applies to a further especially preferred embodiment of the fuel injection valve according to the invention as claimed having an end region of the supporting body which is formed like a spherical cap and interacts with the taper.

Further preferred embodiments of the fuel injection valve according to the invention are defined in the further dependent patent claims.

With a fuel injection valve as claimed, an especially long service life can be achieved in an economical manner. An outlet choke insert on which a pilot valve seat is formed can be made of an especially durable material, whereas a housing body can be made of another, cheaper material.

The invention is explained in more detail with reference to embodiments shown in the drawing, in which, purely schematically:

FIG. 1A shows, in longitudinal section, a fuel injection valve in which a supporting body is in contact with a housing body in a planar manner, an actuator arrangement is arranged in the housing body in an offset manner relative to an injection valve member, and said housing body accommodates an outlet choke insert on which a pilot valve seat of a pilot valve controlled by means of the actuator is integrally formed;

Figure 5:
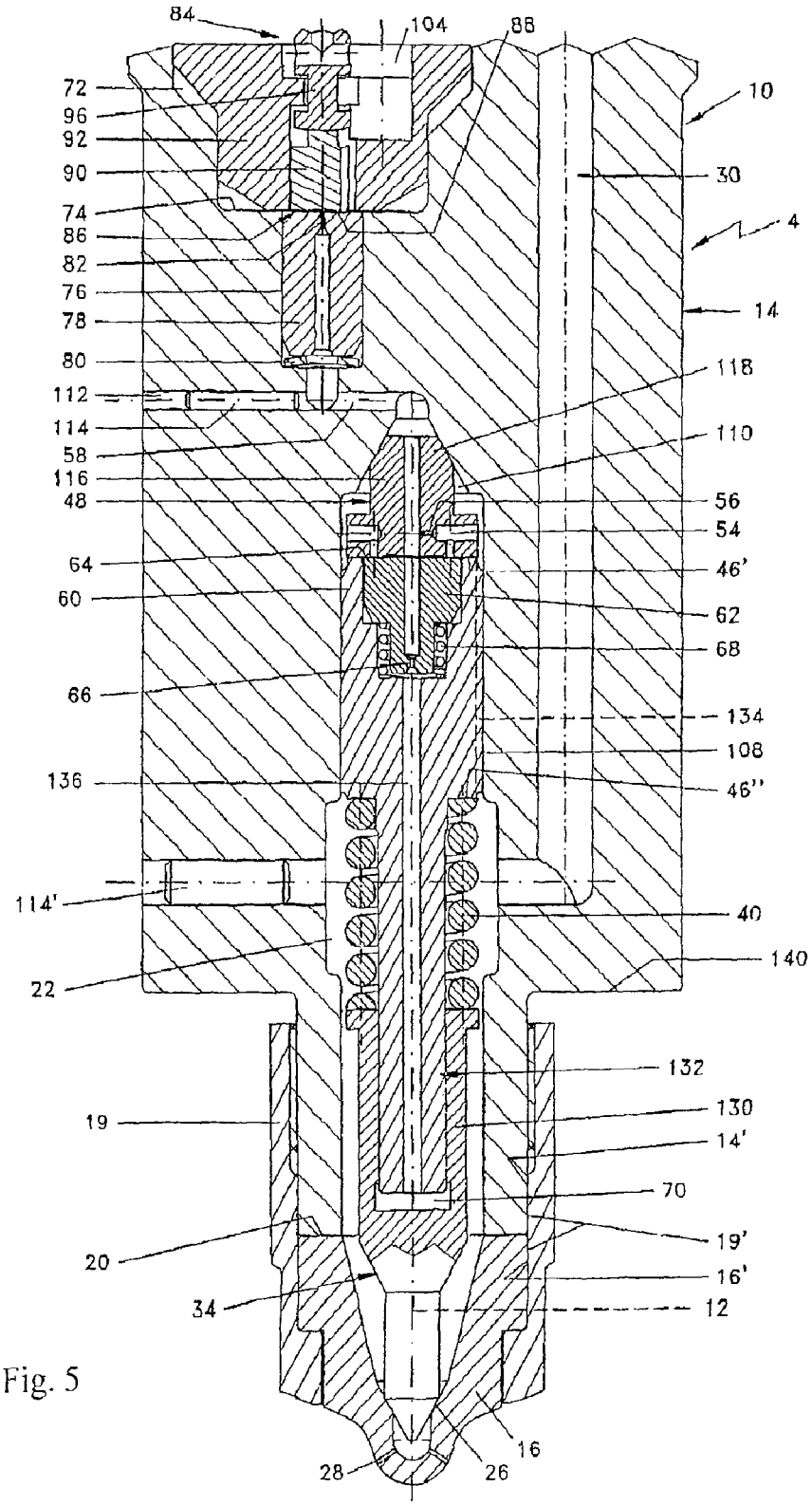
Figure 6:
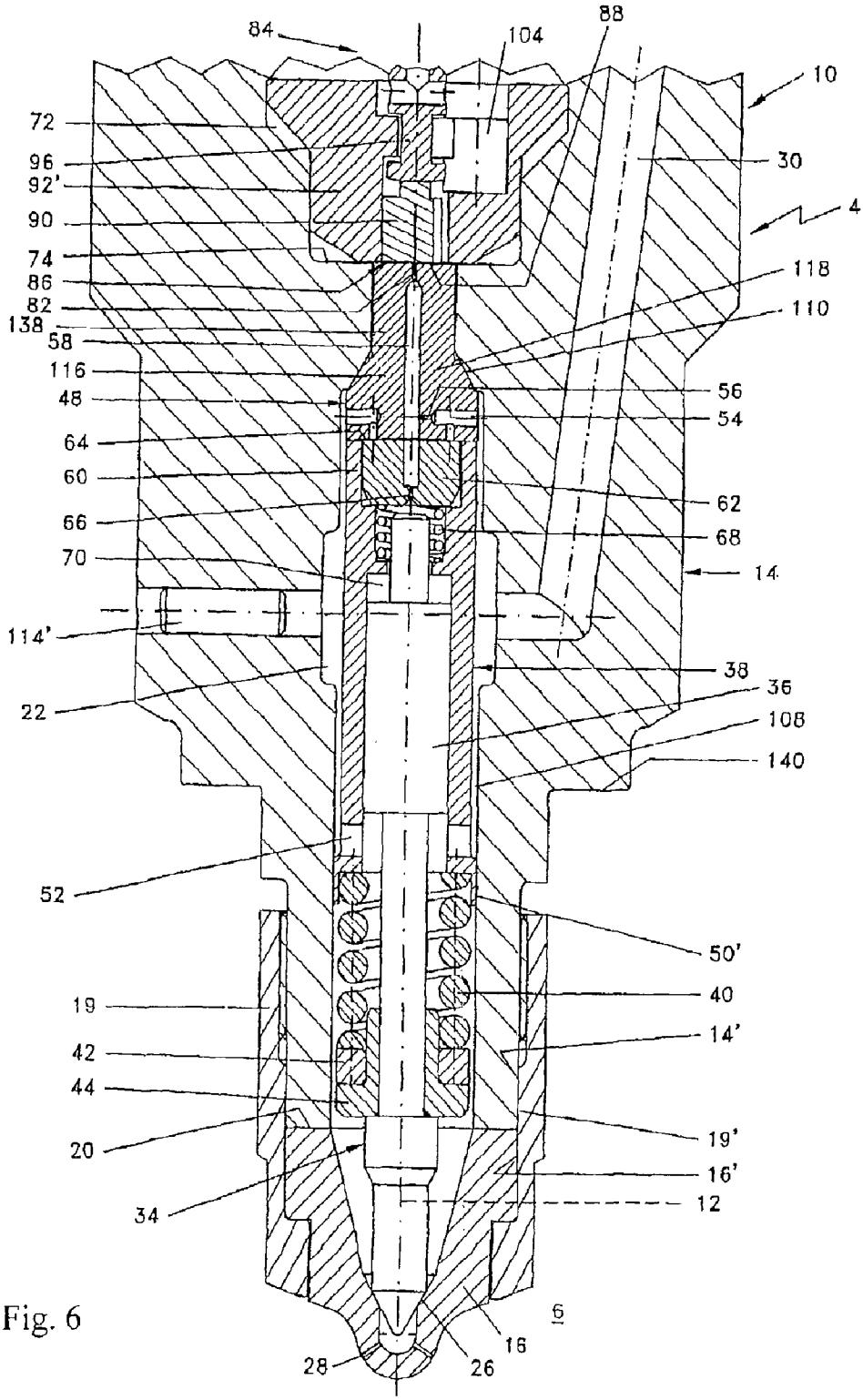

FIG. 5 shows, in longitudinal section, part of a fourth embodiment of the injection valve according to the invention in which the supporting body has a conical end region interacting with the conical taper, and the closing spring is supported on a guide piston which bears against the supporting body and engages in a cylinder-like section of the injection valve member; and FIG. 6 shows, in longitudinal section, part of a fifth embodiment of the injection valve according to the invention in which a cylindrical extension adjoins the conical end region of the supporting body, the pilot valve seat being formed on said cylindrical extension.

Figure 1A:
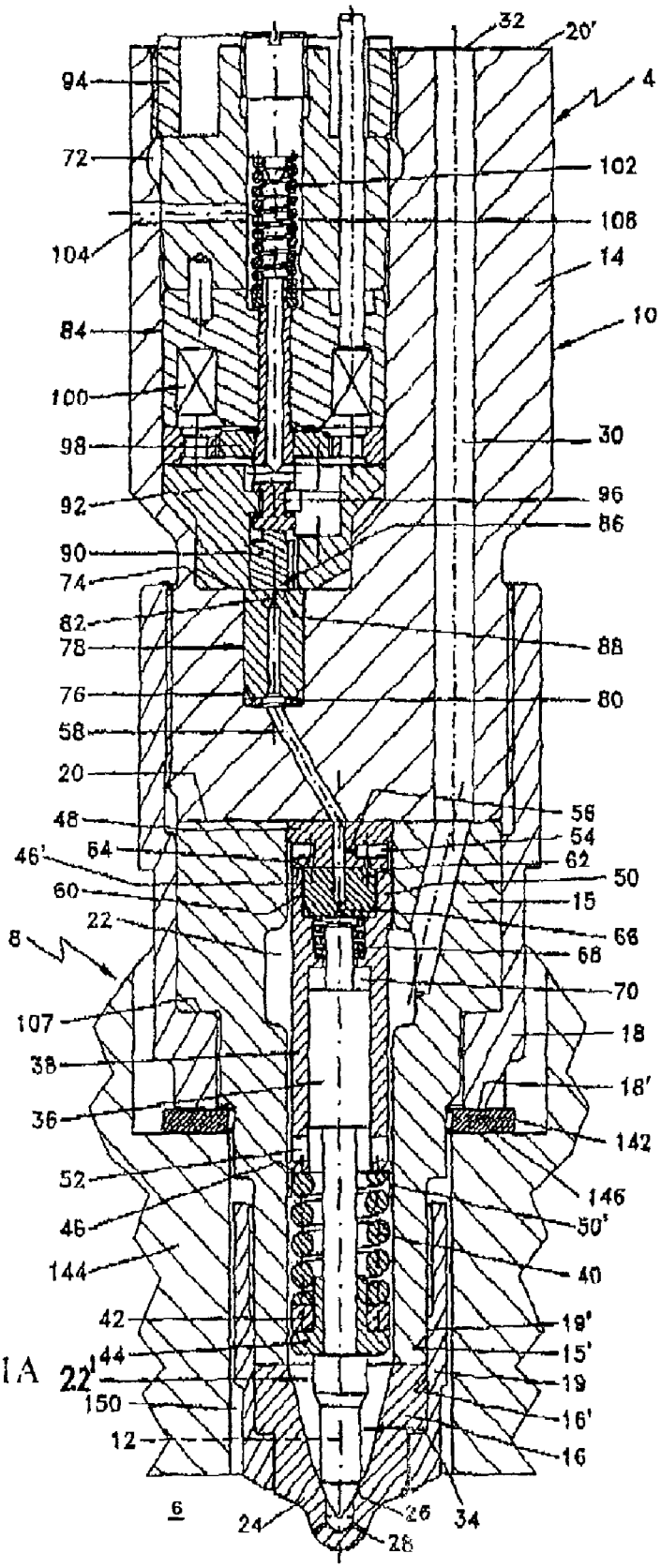
FIG. 1B shows a zoomed-in view of the fuel injection valve according to the embodiment shown in FIG. 1A.
Figure 1B:
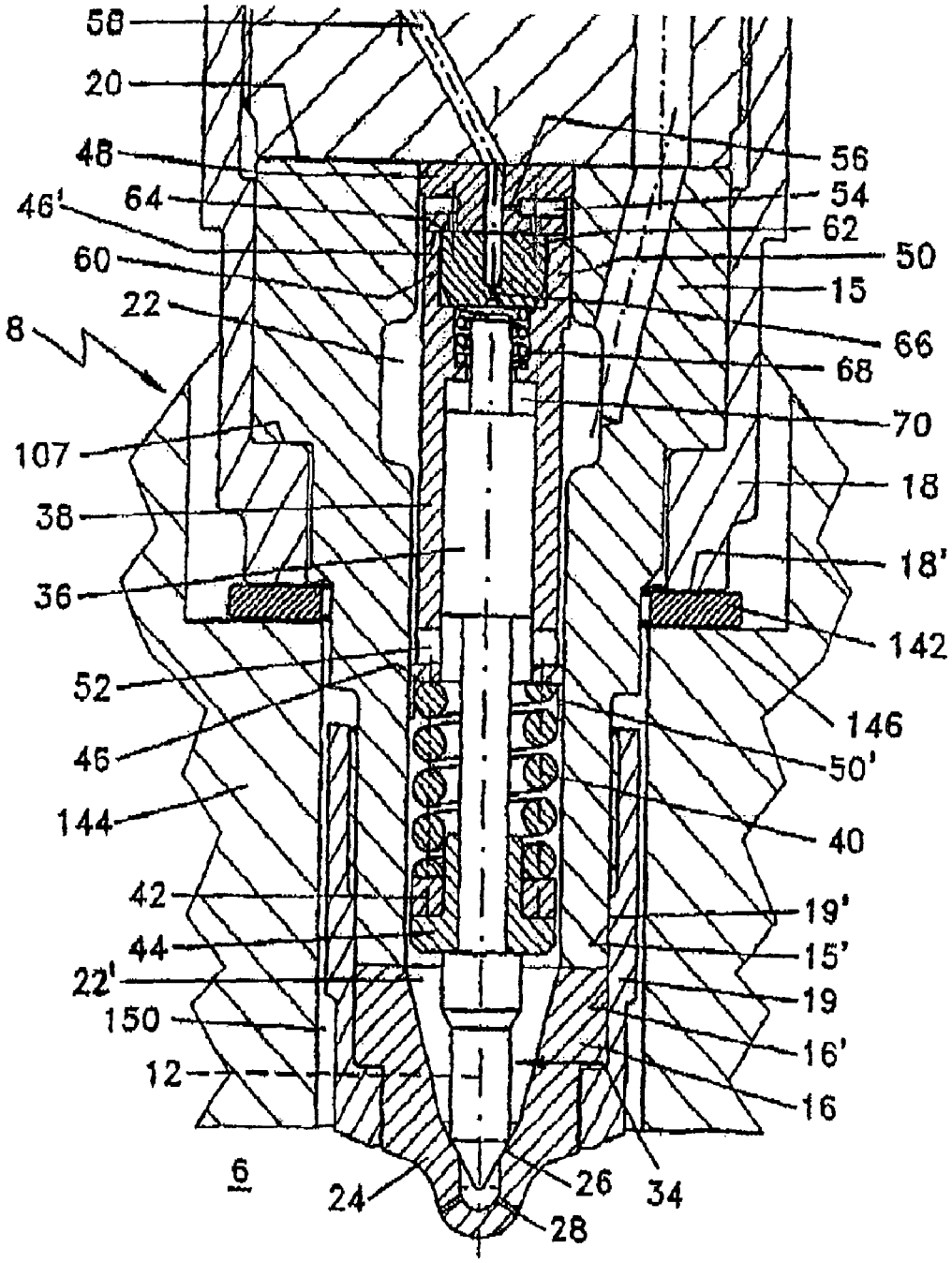

FIGS. 1A and 1B show a fuel injection valve 4 which is intended for intermittent injection of fuel into the combustion space 6 of an internal combustion engine 8. It has an elongated housing 10 which has on the outside essentially the shape of a stepped circular cylinder and whose housing axis is designated by 12. The housing 10 consists of a one-piece housing body 14, a one-piece intermediate body 15 and a one-piece nozzle body 16. The intermediate body 15 is held in sealing contact with an axial end face 20 of the housing body 14 by means of a clamping nut 18 screwed onto the housing body 14 and designed as a cap nut, whereas the nozzle body 16 is held in sealing contact with an axial end face of the intermediate body 15 by means of a cap nut 19 screwed onto the intermediate body 15.

The intermediate body 15 and the nozzle body 16 define a high-pressure space 22 which extends from the end face 20 of the housing body 14 in the direction of the housing axis 12 up to a nozzle tip 24 of the nozzle body 16, where an injection valve seat 26 in the shape of a lateral surface of a truncated cone is integrally formed on the nozzle body 16. Furthermore, the nozzle body 16, in a known manner, has nozzle openings 28 in the region of the nozzle tip 24, the fuel being injected into the combustion space 6 through said nozzle openings 28 when the fuel injection valve is opened.

The high-pressure space 22 is connected to a fuel high-pressure inlet 32 at a free end face 20' of the housing body 14 via a fuel feed channel 30 which runs in the intermediate body 15 obliquely to the housing axis 12 and through the housing body 14 parallel to the housing axis 12 and in such a way as to be offset relative to the latter. The fuel high-pressure inlet 32 is connected in a known manner to a fuel feed, which feeds fuel under very high pressure of, for example, 1600 bar or higher to the fuel injection valve.

The fuel feed channel 30 opens in the intermediate body 15 into a circumferential-groove-like widened portion of the high-pressure space 22.

Located in the high-pressure space 22 concentrically to the housing axis 12 is a needle-shaped injection valve member 34, which on the one hand interacts with the injection valve seat 26 and on the other hand, with a piston-like end region 36, is guided like a double-acting piston in a guide sleeve 38, forming a cylinder, in a close sliding fit of about 0.002-0.010 mm in such a way as to be displaceable in the direction of the housing axis 12.

A closing spring 40 arranged concentrically around the injection valve member 34 is supported at one end in a known manner via a supporting disk 42 and a supporting collar 44 on an encircling shoulder of the injection valve member 34 and acts upon the latter with a closing force directed toward the injection valve seat 26. At the other end, the closing spring 40 is supported on a first end face 46 of the guide sleeve 38, which bears with its opposite second end face 46' against a supporting body 48. The supporting body 48 of pill-like shape is held in sealing contact with the end face 20 of the housing body 14 by the force of the closing spring 40.

Adjacent to the supporting body 48, the guide sleeve 38 has radially projecting centering ribs 50, by means of which it is held in a centered manner relative to the intermediate body 15. Furthermore, the guide sleeve 38, for its centering relative to the intermediate body 15, has a guide ring 50' which projects beyond the first end face 46 and encloses the end region on this side of the closing spring 40 in a centering manner. Since the centering ribs 50 and the centering ring 50' are far apart in the axial direction and the piston-like end region 36 for guiding on the guide sleeve 38 is designed to be long in the direction of the housing axis 12, direct guidance of the injection valve member 34 on the intermediate body 15 or nozzle body 16 can be dispensed with.

There is an annular gap between the guide sleeve 38 and the nozzle body 16, apart from at the centering ribs 50 and the centering ring 50'. The guide sleeve 38 has radial passages 52 in the vicinity of the first end face 46 in order to connect said gap hydraulically with that part 22' of the high-pressure space 22 which lies between the guide sleeve 38 and the injection valve seat 26. This ensures large cross sections of flow for feeding fuel from the fuel feed channel 30 through the gap between guide sleeve 38 and the intermediate body 15, the radial passages 52, the closing spring 40 and the gap between the supporting disk 42 and supporting collar 44 and the intermediate body 15 to the injection valve seat 26.

Furthermore, said gap between the intermediate body 15 and the guide sleeve 38 ensures the fuel feed to fuel inlet channels 54 in the supporting body 48. The latter has a smaller outside diameter in a section adjoining the guide sleeve 38 than in a section facing the housing body 14 or alternatively has milled recessed portions. Said section facing the housing body 14 serves to center the supporting body 48 relative to the intermediate body 15. The fuel inlet channels 54 are formed by radial blind bores starting from the section having a smaller outer radius or from the milled recessed portions and by axial bores leading into said blind bores from the end face facing the injection valve seat 26. Furthermore, a choke bore 56 leads from the bottom of one of said blind bores into a section of a control channel 58 which is concentric to the housing axis 12 and runs through the supporting body 48.

In an end section 60 of the guide sleeve 38 adjoining the supporting body 48, said guide sleeve 38 has a larger inside diameter in order to accommodate an intermediate valve body 62 such that it is movable by a small stroke in the direction of the housing axis 12. The intermediate valve body 62 interacts with an annular intermediate valve seat 64 which is formed on the supporting body 48 and into the region of which the fuel inlet channels 54 open out. When in contact with the supporting body 48, the intermediate valve body 62 closes the fuel inlet channels 54. However, if the intermediate valve body 62 is lifted from the supporting body 48, the control channel 58 is connected to the high-pressure space 22 via the gap between the supporting body 48 and the intermediate valve body 62 and the fuel inlet channels 54.

A further section of the control channel 58 runs concentrically to the housing axis 12 through the intermediate valve body 62, said section being provided with a choke constriction 66 in its end region facing the injection valve seat 26. During hydraulic pressure balance, the intermediate valve body 62 is held in contact with the supporting body 48 by means of a spring 68 supported on the guide sleeve 38.

That section of the control channel 58 which runs through the intermediate valve body 62 opens into a control space 70, which is defined circumferentially by the guide sleeve 38 and axially by the injection valve member 34 on the one side and by the intermediate valve body 62 on the other side.

The housing body 14 has a blind-hole-like actuator-locating recess 72 which starts from the free end face 20' and is offset relative to the housing axis 12 and lies opposite the fuel feed channel 30. Starting from the bottom 74 of the actuator-locating recess 72, a circular-cylindrical recessed portion 76 is incorporated in the housing body 14 coaxially to the substantially circular-cylindrical actuator-locating recess 72. A circular-cylindrical outlet choke insert 78 is inserted into said recessed portion 76 with circumferential clearance and is pressed in the direction of the actuator-locating recess 72 by means of a disk spring 80 supported on the housing body 14. A connecting section of the control channel 58 runs from the center of the axial end face 20 of the housing body 14, obliquely relative to the housing axis 12, to the bottom of the recessed portion 76. Running axially through the outlet choke insert 78 is a further section of the control channel 58 having an outlet choke constriction 82 in that end region of the outlet choke insert 78 which faces the actuator-locating recess 72.

A known electromagnetic actuator 84 for controlling the fuel injection valve 10 via a pilot valve 86 is arranged in the actuator-locating recess 72. A pilot valve seat 88 integrally formed on that end face of the outlet choke insert 78 which faces the actuator 84 and running around the orifice of the control channel 58 interacts with a shank-like pilot valve member 90. The pilot valve member 90 is arranged in a continuous aperture of a sealing element 92 and is guided in a movable manner on the sealing element 92 in the axial direction by means of radially projecting ribs. With an annular end-face sealing face, the sealing element 92 is in sealing contact both with the bottom 74 of the actuator-locating recess 72 and with the outlet choke insert 78—radially outside the pilot valve seat 88. The force resulting in the sealing contact of the outlet choke insert 78 is ensured by the disk spring 80 and by that hydraulic force exerted by the fuel in the high-pressure space 22. The force for the sealing contact of the sealing element 92 with the bottom 74 is produced by a ring nut 94 which is screwed into the housing body 14 and which keeps the actuator 84, in contact with the sealing element 92 on the other side, pressed in the direction of the bottom 74.

The actuator 84 has an actuating shank 96 which interacts with the pilot valve member 90 and to which a plate-like armature 98 is fastened. By electrical energizing of a coil 100, the armature 98 and thus the actuating shank 96 are pulled against the force of an actuator spring 102 acting in the direction of the closed position of the pilot valve 86, which leads to the opening of the pilot valve 86. When the coil 100 is de-energized, the pilot valve 86 is closed by means of the actuator spring 102.

The guide aperture for the pilot valve member 90 in the sealing element 92 is part of a low-pressure outlet channel 104 which extends through the sealing element 92 and the actuating shank 96 to a low-pressure space 106 accommodating the actuator spring 102 and from there through a radially through the housing of the actuator 84 and the housing body 14 to a low-pressure outlet, from which the fuel is returned into a fuel supply tank in a known manner.

The offset arrangement of the actuator 84 relative to the housing axis 12 and therefore relative to the injection valve member 34 and the offset arrangement of the fuel feed channel 30 permit an especially space-saving short embodiment of the fuel injection valve.

The intermediate body 15 has an annular supporting shoulder 107, with which the clamping nut 18 is in sealing contact by means of a mating shoulder. A free, flat, annular end face 18' of the cap nut is designed as a sealing face. In the state fitted onto the internal combustion engine 8, this sealing face is in contact with a disk-shaped sealing ring 142, for example made of copper, which in turn bears against a flat, annular mating sealing face 146 formed on a cylinder head 144 of the internal combustion engine 8. The housing body 14 is clamped against the cylinder head 144 in a generally known manner, for example by means of clamping screws, such that the intermediate body 15, while interacting with the clamping nut 18, the sealing ring 142 and the cylinder head 144, seals off the combustion space 6, defined by the latter and a cylinder of the internal combustion engine 8, from the environment.

There is space for the nozzle body 16 together with the cap nut 19 in an injection valve passage 150 of the cylinder head 144 of normal size on the cylinder-space side of the end face 18', designed as sealing face, of the clamping nut 18 and of the mating sealing face 146. In this case, the nozzle body 16, in a generally conventional manner, projects only slightly with its nozzle tip 24 beyond the cylinder head 144 into the combustion space 6.

In addition to the very compact type of construction of the fuel injection valve 4, the nozzle body 16 of relatively very small design can be economically produced from a more wear-resistant and therefore substantially more expensive material than the remaining housing 10, a factor which advantageously prolongs the service life of the fuel injection valve 4.

A circular-cylindrical inner surface 19' of the cap nut 19 has the function of aligning the nozzle body 16 with the housing axis 12. Outer surfaces 15', 16', interacting with this inner surface 19', of the intermediate body 15 and of the nozzle body 16, respectively, have a fit of a few hundredths of a millimeter, typically 0.01-0.05 mm.

In the fuel injection valve 4 according to FIG. 1, the nozzle body 16 is arranged in a sealing manner on the housing body 14 indirectly via the intermediate body 15. In order to permit a compact, short type of construction, the cap nut 19 is at a small axial distance from the end face 18', acting as sealing face, of the cap nut 18.

In the description of the embodiments shown in FIGS. 2-6, the same designations as further above in connection with the description of the fuel injection valve 4 shown in FIG. 1 are used for the corresponding parts. Furthermore, only the differences from the fuel injection valve 4 shown in FIG. 1 or from the exemplary embodiments already described above are explained below.

Figure 2:
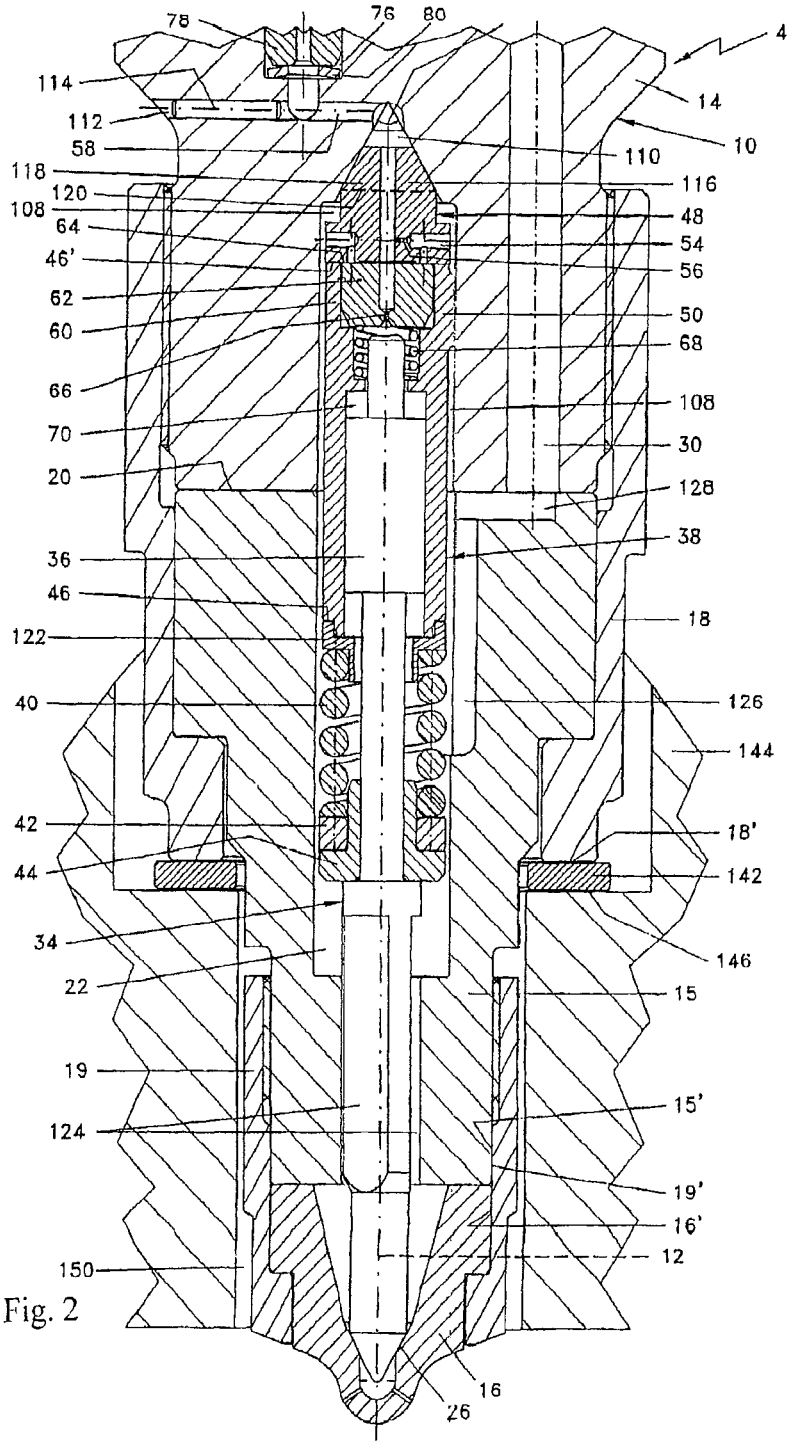
FIG. 2 shows, in longitudinal section, part of an injection valve according to the invention, having a recess which has a conical taper deep in the housing body, in which taper the supporting body engages by means of a conical end region.

In the fuel injection valve 4 shown in FIG. 2, the high-pressure space 22 extends into the housing body 14 through a recess 108 which is coaxial to the housing axis 12 and is open toward the intermediate body 15 and the sealing body 16. This recess 108 is provided with a conical taper 110 in the region of its bottom. From its tapered end remote from the high-pressure space 22, the connecting section of the control channel 58 runs to the outlet choke insert 78, which is again arranged offset. Since the recess 108 extends deep into the housing body 14, part of the connecting section is formed by a radial bore 112, which, as viewed in radial direction outside a short axial connecting bore to the recessed portion 76, is sealed off from the environment by means of a pin 114 pressed into the bore 112. The bore 112 could also be arranged obliquely as in FIG. 1.

The supporting body 48 with the fuel inlet channels 54 and the choke bore 56 has an extension 116 which engages in the taper 110 and is of conical design in an end region 118 interacting with the conical taper 110. The cone angle $\alpha$ of the conical end region 118 is designed to be slightly larger than the corresponding cone angle of the taper 110. This results in a narrow sealing surface 120 (indicated by a broken line) in the direction of the housing axis 12 and in the shape of a lateral surface of a truncated cone. This sealing surface 120 virtually in the form of a circular line lies at that end of the conical end region 118 which faces the high-pressure space 22. Reliable sound sealing of the high-pressure space is achieved as a result.

Since the supporting body 48 is automatically centered as a result of the interaction of the conical end region 118 with the taper 110, no further centering supports are necessary.

The guide sleeve 38, accommodating the intermediate valve body 62 in the same way as in the embodiment shown in FIG. 1 and guiding the piston-like end region 36 of the injection valve member 34 in a cylinder-like manner, again has centering ribs 50, but no longer has any centering ring 50'.

Put onto the first end face 46 of the guide sleeve 38 in order to center the closing spring 40 is a cap-like annular disk 122, with which the end of the closing spring 40 on this side is in contact and from which an annular centering extension engages in the closing spring 40.

The injection valve member 34 is guided on the intermediate body 15 by means of radially projecting guide ribs 124 in a region between the closing spring 40 and the end interacting with the injection valve seat 26 of the nozzle body 16. Since the piston-like end region 36 of the injection valve member 34 is designed to be long in the axial direction relative to its diameter, a central arrangement of the guide sleeve 38 over its entire length is ensured. Finally, the guide sleeve 38 also no longer has any radial passages 52, since fuel can now flow freely from the fuel feed channel 30 to the injection valve seat 26. In order to additionally reduce the flow resistance, the otherwise circular-cylindrical high-pressure space 22 is widened by an axially running groove 126 which is relieved on the intermediate body 15 and runs from that end of the latter which faces the housing body 14 up to approximately the middle of the closing spring 40. Opening into this groove 126 is a radial groove 128 which forms a section of the fuel feed channel 30 and is connected to that section of the fuel feed channel 30 which runs parallel to the housing axis 12 through the housing body 14.

Also in the fuel injection valve according to FIG. 2, the nozzle body 16 of small design is arranged in a sealing manner on the housing body 14 indirectly via the intermediate body 15. There is space for about half the length of the intermediate body 15 together with the nozzle body 16 and the cap nut 19 in the injection valve passage 150 of the cylinder head 144. The sealing is effected in the same manner as in the fuel injection valve 4 shown in FIG. 1.

Figure 3:
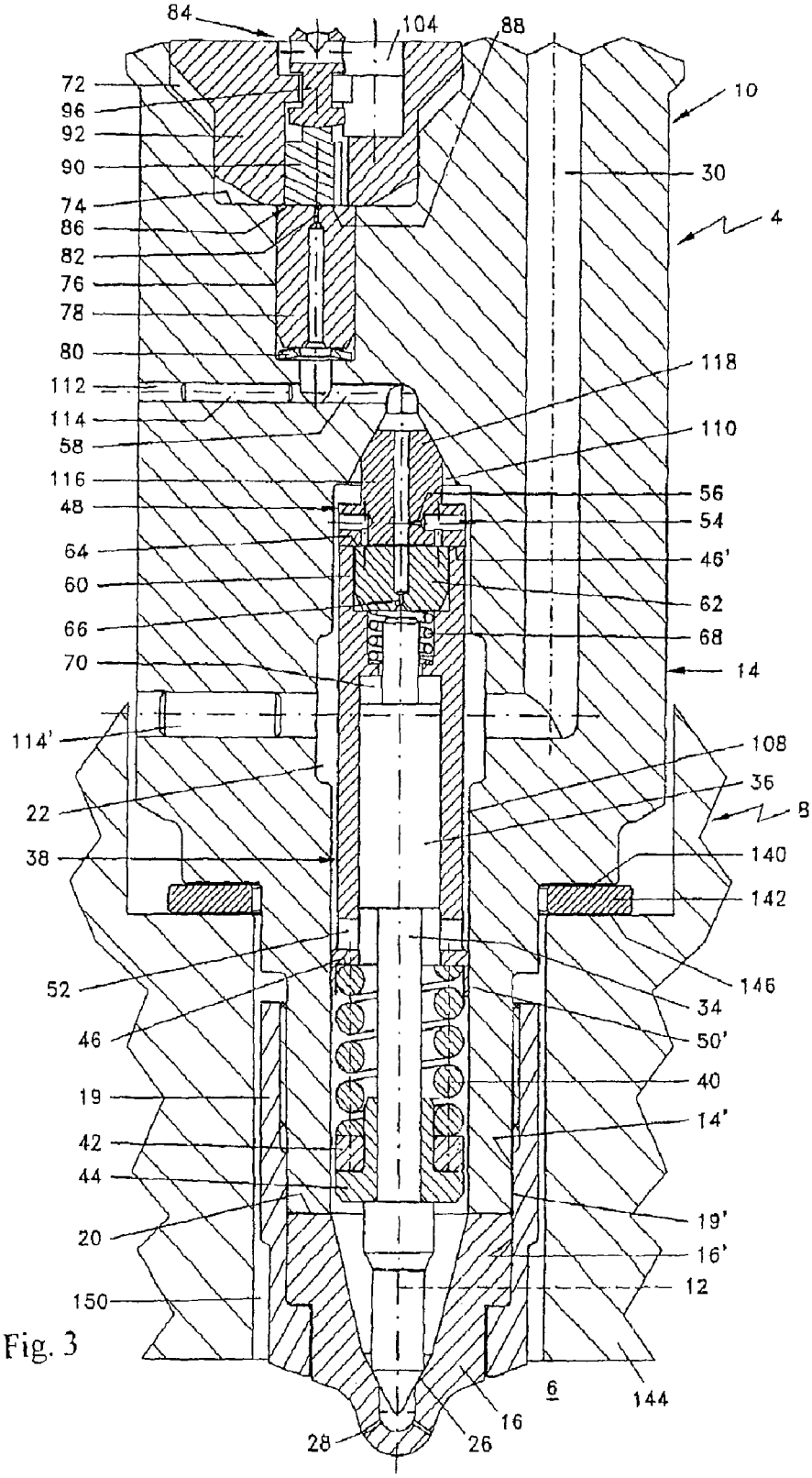
FIG. 3 shows, likewise in longitudinal section, part of a second embodiment of the fuel injection valve according to the invention having an especially short overall length.

In the embodiment of the fuel injection valve 4 shown in FIG. 3, the nozzle body 16 is again designed to be short, but the housing body 14 is designed to be longer. The intermediate body 15 according to FIGS. 1 and 2 is integrated in one piece in the housing body 14. Most of the high-pressure space 22 is located in the housing body 14, and the recess 108 with the conical taper 110 at the end reaches correspondingly deeper into the housing body 14. The cap nut 19 is designed with a correspondingly smaller diameter and is screwed onto a stub of the housing body 14. Here, the nozzle body 16 is arranged directly on the housing body 14 in a sealing manner and is fastened to the latter by means of the cap nut 19—there is no clamping nut 18.

The supporting body 48 with its conical end region 118 and the control channel 58 are designed in the same way as in the embodiment shown in FIG. 2.

The guide sleeve 38 is again in sealing contact with the supporting body 48 by means of its second end face 46'. It has no centering ribs 50 (see FIGS. 1 and 2) but rather a centering ring 50', as already shown in FIG. 1, and therefore also radial passages 52 for the fuel.

The centering of the guide sleeve 38 at the supporting body 48 is effected during the fitting by the long embodiment, guided in the guide sleeve 38 in a close sliding fit, of the piston-like end region 36 of the injection valve member 34, and the centering of the conical free end region of the injection valve member 34 is effected by interaction with the injection valve seat 26 of the nozzle body 16.

As a result of the short type of construction as viewed in the axial direction, additional guidance of the injection valve member 34, for example by means of guide ribs 124 shown in FIG. 2, can be dispensed with.

The fuel feed channel 30 runs entirely in the housing body 14, wherein it is formed by a blind-hole-like bore, parallel to the housing axis 12 but offset relative to the latter, and by a bore which opens into the blind-hole-like bore, runs at right angles to the housing axis 12 and is tightly closed relative to the environment by another pressed-in pin 114'. At the point at which the fuel feed channel 30 opens into the high-pressure space 22, the recess 108 defining the latter has a groove-like encircling widened portion.

The housing body 14 has, at a slight axial distance from the cap nut 19, a shoulder-like, flat, annular sealing face 140. When the fuel injection valve 4 is fitted onto the cylinder head 144, said sealing face 140 is in contact with the disk-shaped sealing ring 142, for example made of copper, which in turn is in contact with the annular mating sealing face 146 formed on the cylinder head 144. The housing body 14 is clamped against the cylinder head 144 in a generally known manner, for example by means of clamping screws, such that, while interacting with the sealing ring 142 and the cylinder head 144, it seals off the combustion space 6, defined by the latter and the cylinder of the internal combustion engine 8, from the environment.

There is space for the nozzle body 16 together with the cap nut 19 in the injection valve passage 150 of the cylinder head 144 on the cylinder-space side of the sealing face 140 and of the mating sealing face 146. In this case, the nozzle body 16, as generally known, projects only slightly with its injection tip beyond the cylinder head 144 into the combustion space 6.

In this embodiment, too, the cap nut 19, for centering the nozzle body 16, has the inner surface 19', which, with a fit of typically 0.01-0.05 mm, interacts with the outer surface 16' of the nozzle body 16 and an outer surface 14' (corresponding to the outer surface 15' of the intermediate body 15) of the housing body 14.

Figure 4:
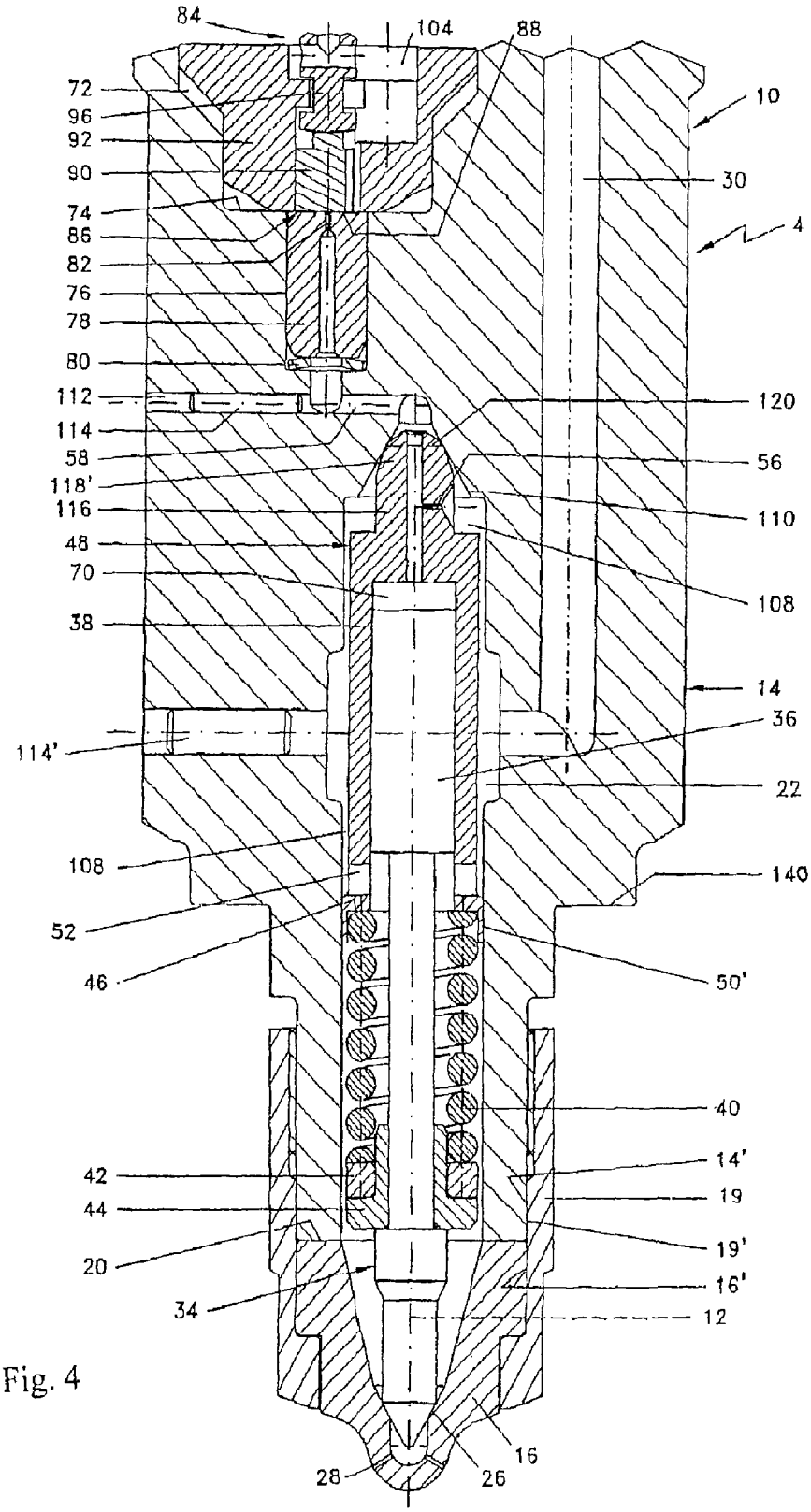
FIG. 4 shows, in longitudinal section, part of a third embodiment of the fuel injection valve according to the invention in which the supporting body has an end region formed like a spherical cap and interacting with the conical taper in the housing body, and in which a guide sleeve for the injection valve member is integrally formed in one piece on the supporting body.

In the embodiment of the fuel injection valve shown in FIG. 4, the housing body 14 and the nozzle body 16 are designed in the same way as in the embodiment shown in FIG. 3.

However, the supporting body 48 and the guide sleeve 38, in which the injection valve member 34 is guided with its piston-like end region 36 in a close sliding fit, are now designed in one piece. The extension 116 of the supporting body 48 is formed with a spherical-cap-like end region 118' which interacts in a sealing manner with the conical taper 110 of the recess 108. In this embodiment, too, a reliable seal is achieved by achieving a sealing surface 120 which is very narrow in the axial direction and is virtually in the form of a circular line.

In contrast to the embodiments shown in FIGS. 1, 2 and 3, no intermediate valve body 62 is accommodated in the guide sleeve 38. That section of the control channel 58 which runs through the supporting body 48 concentrically to the housing axis 12 opens directly into the control space 70 without a choke, said control space 70 being defined by the piston-like end region 36 of the injection valve member 34 and by the guide sleeve 38 formed in one piece with the supporting body 48.

As a result of this one-piece embodiment, the guide sleeve 38 has no centering ribs 50 (cf. FIGS. 1 and 2), but rather a centering ring 50', as known from FIGS. 1 and 3.

Running radially through the extension 116 of the supporting body 48 is a choke bore 56 which connects the control channel 58 and therefore the control space 70 to the high-pressure space 22.

The sealing face of the housing body 14 is designated by 140. As is also the case in the embodiment according to FIG. 3, the closing spring 40 is located entirely in the recess 108 of the housing body 14, and the supporting body 48, the guide sleeve 38, the injection valve member 34 and the closing spring 40 are fitted into said recess 108 from the side of the nozzle body 16.

In the embodiment of the fuel injection valve shown in FIG. 5, the housing 10 with the housing body 14, having the sealing face 140, and the nozzle body 16 is designed in a very similar manner to the embodiments shown in FIGS. 3 and 4. The recess 108 reaching deep into the housing body 14 is again provided with a conical taper 110 in its end region at the bottom. The extension 116 having a conical end region 118 of the supporting body 48 again engages in said taper 110, this extension 116 being designed in the same way as in the embodiments shown in FIGS. 2 and 3.

The closing spring 40 is supported on one side on the free end of the injection valve member 34, which is of cylindrical design in an end region 130 facing the closing spring 40. A guide piston 132 engages in this cylindrical end region with a close sliding fit of about 0.002-0.010 mm and defines, together with the cylindrical end region 130 of the injection valve member 34, the control space 70. The guide piston 132 of one-piece design runs through the closing spring 40, which is supported on a supporting shoulder 46" of the guide piston 132 with its end remote from the injection valve member 34. With its second end face 46', the guide piston 132 is in sealing contact with the supporting body 48 under the effect of the force of the closing spring 40. Between the supporting shoulder 46" for the closing spring 40 and the second end face 46', the guide piston 132 is kept centered in contact with the housing body 14, a longitudinal groove 134 which runs parallel to the housing axis 12 ensuring the connection between the high-pressure space 22 and the fuel inlet channels 54 in the supporting body 48.

Running through the guide piston 132 concentrically to the housing axis 12 is a control passage 136 which is widened in a step-like manner in the end section 60 facing the supporting body 48 in order to accommodate an intermediate valve body 62. The latter, in the same way as in the embodiments shown in FIGS. 1-3, is again displaceable in the axial direction by a small stroke and, during hydraulic pressure balance, is held in contact with the supporting body 48 by means of the spring 68 supported on the guide piston 132 in order to close the fuel inlet channels 54. The intermediate valve body 62 has a stub engaging in the spring 68, corresponding to a stub projecting from the piston-like end region 36 in the embodiments shown in FIGS. 1-3. The section of the control channel 58 having the choke constriction 66 again runs through the intermediate valve body 62 and its stub. Through said choke constriction 66 and the control passage 136, the control space 70 is connected to the high-pressure space 22 via the choke bore 56 when intermediate valve body 62 is in contact with the supporting body 48.

The embodiment of the fuel injection valve shown in FIG. 6 is very similar to that in the embodiment shown in FIG. 3. The essential difference consists in the fact that the actuator 84 is arranged coaxially to the housing axis 12. The pilot valve seat 88 is integrally formed on an outlet choke extension 138 of the supporting body 48. With its conical end region 118, the supporting body 48 engages in the conical taper 110 of the recess 108 in the housing body 14 and is again in sealing contact with the latter. The outlet choke extension 138 runs away from the conical end region 118 and is accommodated with radial clearance in the corresponding passage running from the taper 110 to the bottom 74 of the actuator-locating recess 72. As in the outlet choke insert 78 shown in the embodiments according to FIGS. 1-5, the outlet choke constriction 82 is formed in the outlet choke extension 138. In this embodiment, the pressure forces, caused by the high pressure in the recess 108, are completely absorbed by the seal between the conical end region 118 of the supporting body 48 and the taper 110 in the housing body 14. Here, the element 92', which in FIGS. 1 to 5 is designed as sealing element 92, need not assume a function of either sealing or supporting the outlet choke extension 138. These provisions are dispensed with in FIG. 6 and consequently they need not be taken into account in the embodiment or during the assembly of the components involved. Also in the embodiment according to FIG. 6, the housing body 14 has the annular sealing face 140 for the sealing of the combustion space (FIG. 3).

A common feature of all the exemplary embodiments shown in FIGS. 2-6 is the fact that the housing body 14 has a recess 108 open in the direction of the nozzle body 16 and having a conical taper 110, and the supporting body 48 engages in this recess 108 and is held in sealing contact with the taper 110 by means of the closing spring 40.

In all the embodiments shown, the nozzle body 16 is especially short, which permits a very compact embodiment of the fuel injection valve 10. However, it has to be taken into account that the injection valve member 34 and the nozzle body 16 are readily aligned with the housing axis 12, such that the injection valve seat 26 seals and the functioning is satisfactory during the opening and closing of the injection valve.

On the housing side, this is achieved by the taper 110, the recess 108 (at least in the region of the guide 50'), the sealing face 20 and possibly the outer circumference 14' being machined in a single setup.

If this should be necessary for centering purposes, in the embodiments according to FIGS. 1 and 2 the clamping nut 18 could be formed with an inner surface and the housing body 14 and intermediate body 15 could be formed with corresponding outer surfaces in a similar manner to the surfaces 14', 16', 19'.

On the nozzle-body side, the effective centering, as described further above, is achieved with the surfaces 14', 16' and 19'.

The embodiments of the fuel injection valves shown in FIGS. 1, 2, 3, 5 and 6 function in a known manner as follows. Starting from the state which is shown in said figures and in which the pilot valve 86 is closed, the injection valve member 34 is in contact with the injection valve seat 26 and the intermediate body 62 is in contact with the supporting body 48 in such a way as to close the fuel inlet channels 54. The same pressure as in the high-pressure space 22 prevails in the control space 70 and in the control channel 58.

To initiate an injection operation, the actuator 84 is energized, as a result of which the pilot valve member 90 is lifted from the pilot valve seat 88 under the hydraulic force of the fuel and connects the control channel 58 through the outlet choke constriction 82 to the low-pressure outlet channel 104. The pressure in the control space 70 drops, as a result of which the injection valve member 34 is lifted from the injection valve seat 26. In the process, the intermediate valve body 62 remains in contact with the supporting body 48.

For ending the injection operation, the actuator 84 is de-energized, as a result of which the pilot valve 86 is closed. As a result of the more rapid pressure increase in the control channel 58 relative to the pressure increase in the control space 70, the intermediate valve body 62 is lifted from its contact with the supporting body 48, as a result of which the entire gap between the supporting body 48 and the intermediate valve body 62 is connected to the high-pressure space 22 by the fuel inlet channels 54 and the pressure in the control space 70 increases very rapidly. This in turn leads to a very rapid closing movement of the injection valve member 34. Through the choke constriction 66, the pressure in the control space 70 then adapts itself to the pressure in the high-pressure space 22, as a result of which the intermediate valve body 62 again comes into contact with the supporting body 48 under the force of the spring 68. The fuel injection valve is ready for the next injection of fuel.

For the description of the functioning of the embodiment of the fuel injection valve 4 shown in FIG. 4, the situation shown there is taken as the starting point. The pilot valve 86 is closed and the injection valve member 34 is in contact with the injection valve seat 26. Pressure balance prevails between the high-pressure space 22, the control space 70 and the control channel 58.

To initiate an injection operation, the actuator 84 is energized, as a result of which the pilot valve member 90 is lifted from the pilot valve seat 88 under the hydraulic force of the fuel. As a result, the control channel 58 is connected through the outlet choke constriction 82 to the low-pressure outlet channel 104 (see FIG. 1). The pressure in the control space 70 drops, which leads to the lifting of the injection valve member 34 from the injection valve seat 26. Fuel is injected under high pressure through the nozzle openings 28 into the combustion space.

To end the injection operation, the actuator 84 is de-energized, as a result of which the pilot valve 86 is closed. As a result of the feed of fuel through the choke bore 56, the pressure in the control space 70 increases, which causes a movement of the injection valve member 34 toward the injection valve seat 26. As soon as the injection valve member 34 is in contact with the injection valve seat 26, the injection operation is ended.

It is perfectly conceivable to design the conical end regions 118 of the supporting bodies 48 in a spherical-cap shape in accordance with the end region 118', and vice versa.

It is also possible to design the conical taper 110 and the conical end regions 118 with identical cone angles $\alpha$.

Furthermore, in the fuel injection valves 4 according to FIGS. 1 and 2, the intermediate body 15 can be formed in one piece with the nozzle body 16. This nozzle body 16 has a correspondingly larger axial length, such that it is in direct contact with the axial end face 20 of the housing body 14. It is then held on the housing body 14 by the clamping nut 18; the cap nut 19 is dispensed with.

In the fuel injection valve 4 shown in FIG. 6, it is conceivable to arrange the outlet choke constriction 82, and correspondingly also the pilot valve 86, eccentrically to the housing axis 12. The control channel 58 can then run obliquely to the housing axis 12 or parallel to the latter in the housing body 48, but in a correspondingly offset manner. It is also possible to place the outlet choke extension 138 eccentrically.

The invention claimed is:

1. A fuel injection valve for intermittent injection of fuel into the combustion space of an internal combustion engine, the fuel injection valve comprising:

an elongated housing which has a housing body and a nozzle body with an injection valve seat;

a high-pressure space which is arranged in the housing and is connected to a fuel high-pressure inlet and the injection valve seat;

an injection valve member which is arranged in the housing in a longitudinally adjustable manner and interacts with the injection valve seat;

a guide sleeve having a first end face and an opposite second end face; and a closing spring which is supported on a first side on the injection valve member and acts upon the injection valve member with a closing force directed toward the injection valve seat and which is supported on a second side on the first end face of the guide sleeve, the injection valve member being guided solely on the guide sleeve and in a piston-like manner in the guide sleeve in a sliding fit, wherein the guide sleeve is supported with the opposite second end face thereof on a supporting body and in the process presses the supporting body against the housing as to seal the high-pressure space, and wherein a fuel feed channel that is connected to the fuel high-pressure inlet opens into an annular gap between the guide sleeve and the housing, and wherein the guide sleeve has a centering element at the first end face for centering relative to the housing and at least one passage in the vicinity of the first end face for a hydraulic connection of the annular gap and a part of the high-pressure space that lies between the guide sleeve and the injection valve seat.

2. The fuel injection valve as claimed in claim 1, wherein the centering element has a centering ring, and the at least one passage for the hydraulic connection runs in a radial direction through the guide sleeve adjacent to the centering ring.

3. The fuel injection valve as claimed in claim 1, wherein the housing body has a recess open in the direction of the nozzle body and having a taper, the supporting body engages in the recess and is held in sealing contact with the taper by means of the closing spring.

4. The fuel injection valve as claimed in claim 3, wherein the taper is of conical design.

5. The fuel injection valve as claimed in claim 4, wherein the supporting body has a conical end region which interacts with the taper and whose cone angle ($\alpha$) is greater than the cone angle of the taper.

6. The fuel injection valve as claimed in claim 3, wherein the supporting body has an end region which is formed like a spherical cap and interacts with the taper.

7. The fuel injection valve as claimed in claim 3, wherein the guide sleeve is formed in one piece together with the supporting body.

8. The fuel injection valve as claimed in claim 3, wherein the guide sleeve is in contact with the supporting body by means of a second end face and, with an end region adjoining the second end face, accommodates an intermediate valve body which interacts with an intermediate valve seat formed on the supporting body and can be lifted from said intermediate valve seat in order to assist a rapid closing movement of the injection valve member.

9. The fuel injection valve as claimed in claim 1, wherein a section of a control channel runs through the supporting body, and wherein, for controlling the movement of the injection valve member by means of a pilot valve, the section of the control channel is connected to a low-pressure outlet and is separable again from the low-pressure outlet.

10. The fuel injection valve as claimed in claim 1, wherein the supporting body has an outlet choke extension, on which a pilot valve seat is integrally formed.

11. The fuel injection valve as claimed in claim 10, wherein the outlet choke extension is accommodated in the housing body with clearance.

12. The fuel injection valve as claimed in claim 9, wherein the housing body accommodates an outlet choke insert, preferably with clearance, through which the control channel runs and on which a pilot valve seat is formed on one side and on which a supporting spring supported on the housing body acts on the other side in order to hold the outlet choke insert in contact with a sealing element.

13. The fuel injection valve as claimed in claim 12, wherein the sealing element is held in sealing contact with the housing body, and the outlet choke insert lies in sealing contact against the sealing element.

14. The fuel injection valve as claimed in claim 12, wherein an actuator interacting with the pilot valve member, the pilot valve member and the outlet choke insert are arranged offset relative to the supporting body and the injection valve member, and in that a connecting section of the control channel runs in the housing body, said connecting section connecting that section of the control channel which runs through the supporting body to a section in the outlet choke insert that has a choke.

15. The fuel injection valve as claimed in claim 1, wherein the recess, the taper, a sealing face on an end face, facing the nozzle body, of the housing body, and preferably the outer surface of the housing body of an end region facing the nozzle body are produced in a single setup of the housing body.

16. The fuel injection valve as claimed in claim 1, wherein the guide sleeve has, adjacent to the supporting body, radially projecting centering ribs.

17. The fuel injection valve as claimed in claim 1 wherein the supporting body is of pill-like shape, the pill-like shape being at least one of, cylindrical, spherical, annular shape, or any combination thereof.

18. The fuel injection valve as claimed in claim 1, wherein the injection valve member is guided in the guide sleeve in a close sliding fit.

* * * * *